US007788745B1

(12) United States Patent
Beaton

(10) Patent No.: US 7,788,745 B1
(45) Date of Patent: Sep. 7, 2010

(54) HAMMOCK

(76) Inventor: Jonathan Beaton, 481 Kalalau Pl., Kihei, HI (US) 96753

( * ) Notice: Subject to any disclaimer, the term of this patent is extended or adjusted under 35 U.S.C. 154(b) by 0 days.

(21) Appl. No.: 12/494,992

(22) Filed: Jun. 30, 2009

Related U.S. Application Data

(60) Provisional application No. 61/076,897, filed on Jun. 30, 2008.

(51) Int. Cl.
*A45F 3/22* (2006.01)

(52) U.S. Cl. ..... 5/120; 5/122; 5/123

(58) Field of Classification Search ..... 5/120–123, 5/127, 187, 98.3
See application file for complete search history.

(56) References Cited

U.S. PATENT DOCUMENTS

| | | | | | |
|---|---|---|---|---|---|
| 223,588 | A | | 1/1880 | Hicks | |
| 312,988 | A | * | 2/1885 | Ewing | 5/98.3 |
| 451,186 | A | * | 4/1891 | Patterson | 5/123 |
| 656,534 | A | | 8/1900 | Fishburn | |
| 803,091 | A | | 10/1905 | Brayshaw | |
| 1,248,838 | A | | 12/1917 | Foster | |
| 1,814,579 | A | * | 7/1931 | Ames | 5/122 |
| 1,917,518 | A | * | 7/1933 | Goudie | 5/120 |
| 3,593,352 | A | | 7/1971 | Britt | |
| 4,198,045 | A | | 4/1980 | Miller | |
| 4,800,601 | A | * | 1/1989 | DeCaro | 5/123 |
| 5,655,235 | A | * | 8/1997 | DeAth | 5/123 |
| 5,715,552 | A | * | 2/1998 | DeAth | 5/123 |
| 5,729,845 | A | * | 3/1998 | Hsu | 5/120 |
| D408,166 | S | | 4/1999 | Bayless | |
| 5,983,422 | A | | 11/1999 | Bayless | |
| 6,314,594 | B1 | * | 11/2001 | Meoli et al. | 5/120 |
| 6,701,549 | B1 | | 3/2004 | Eriksen | |
| 6,782,570 | B1 | * | 8/2004 | Bhatt | 5/122 |
| 6,957,453 | B2 | * | 10/2005 | Branch, III | 5/123 |
| 2005/0060802 | A1 | | 3/2005 | Zhong | |

* cited by examiner

*Primary Examiner*—Michael Trettel
(74) *Attorney, Agent, or Firm*—QuickPatents, Inc.; Kevin Prince

(57) ABSTRACT

A hammock for supporting a load above a surface by a support structure is disclosed. The hammock includes two preferred embodiments, one being a complete hammock and the other that converts an existing hammock to the improved device. The hammock includes a flexible sheet which includes a plurality of cord engagement means. The first hammock embodiment includes a pair of rigid rods attached to the flexible sheet at the cord engagement means with an elastic cord. The hanging means fixes each rod to the support structure. In the second embodiment, the elongated support means is a non-elastic elongated transition member which includes a plurality of cord engagement means and a pair of hammock support attachments. The hanging means includes an elongated rigid member fixed to the support structure by a non-elastic tensile member. As such, the pair of elongated transition members and elastic cords may be added to existing hammocks in order to make the present invention.

9 Claims, 6 Drawing Sheets

HAMMOCK

CROSS-REFERENCE TO RELATED APPLICATIONS

This application claims the benefit of U.S. Provisional Patent Application 61/076,897, filed on Jun. 30, 2008, and incorporated herein by reference.

STATEMENT REGARDING FEDERALLY SPONSORED RESEARCH AND DEVELOPMENT

Not Applicable.

FIELD OF THE INVENTION

This invention relates to hammocks, and more particularly to a hammock which uses elastic cords for supporting a load.

DISCUSSION OF RELATED ART

Hammocks are widely used for recreational purposes. The hammock is one of the most popular methods used for sleeping or resting. They are used indoors as well as outdoors since they are portable and can quickly be relocated. As hammocks have been popular for many centuries, numerous types of foldable hammock supporting structures for holding the hammock in an outstretched position have been suggested. However, such hammock supports are typically complex in construction, are often difficult to use, and do not result in better form-fitting of the hammock to each individual user.

In several prior arts, hammocks which are collapsible and self supporting are mentioned. For example, in U.S. Pat. No. 3,593,352 issued to Britt on Jul. 20, 1971 and in U.S. Pat. No. 5,983,422 issued to Bayless on Nov. 16, 1997, the supporting framework of the hammock is fabricated in stock metal tubes or other common hardware. But, again, there is nothing in these prior art patents that results in greater comfort for the user than with traditionally-supported hammocks.

In U.S. Pat. No. 6,701,549 to Eriksen on Mar. 9, 2004, the conventional hammock is re-designed as a comfortable alternative to resting on the ground using an air mattress or foam pad. Although this hammock allows the user to lie flat on his back or his side, as in a bed, this hammock is not suspended in a position above the ground and therefore doesn't provide certain advantages that a suspended hammock affords.

In both prior art U.S. Pat. No. 5,113,538 to Branch on May 19, 1992, and U.S. Pat. No. 5,659,907 on Aug. 26, 1997, hammocks with a hammock stand are taught which each consist of three elongated structural members joined together axially at oblique angles by means of unique pairs of brackets and a pair of posts. Here the support sheet material is supported by securing it to the hooks included on the posts. As such, the supporting sheet material does not conform to the shape and comfort of the user or the load.

In U.S. Pat. No. 5,659,907 to Law on Aug. 26, 1997, a four-point rope sling hammock system is disclosed. This hammock system includes a rope sling bed connected to a stand by four chains, each extending between respective bed spreader bars and stand support members in a line generally parallel to the longitudinal axis of hammock bed. This hammock is adjustable but does not conform to the size and shape of the load.

U.S. Pat. No. 7,089,610 to Zhong on Mar. 9, 2004, includes a portable hammock for outdoor use. This invention has a support frame which consists of a pair of inclined erecting means, making this hammock flexible and able to meet various demands in use; but such a device does not provide additional comfort to the user.

Therefore, there is a need for a hammock that suspends a load above the surface and better conforms to the shape and size of the load than the prior art hammocks. Such a needed device would utilize elastic cords to create a more comfortable and conforming hammock sheet to better cradle a person. Such a needed device would further be adaptable to existing hammocks. The present invention accomplishes these objectives.

SUMMARY OF THE INVENTION

The present device is a hammock for supporting a load above a surface by a support structure. The hammock includes two preferred embodiments, one which includes the complete hammock and one that may be used to convert an existing hammock to the improved device. Each embodiment of the hammock includes a flexible sheet. The flexible sheet has at least two opposing edges. A plurality of cord engagement means is further included proximate each opposing edge of the flexible sheet. The cord engagement means may be a grommet fixed through the flexible sheet, for example.

In the first preferred embodiment, the hammock further includes a pair of elongated supporting members. Each elongated supporting member is a rigid rod attached to one edge of the flexible sheet at the cord engagement means with at least one elastic cord. At least one hanging means is included that fixes each elongated supporting member to the support structure. The hanging means may be typically an arrangement of metallic chains, ropes, or the like.

In the second preferred embodiment of the invention, the elongated support means is a non-elastic elongated transition member. The non-elastic elongated transition member has a proximal edge and a distal edge and further includes a plurality of cord engagement means proximate the proximal edge of the non-elastic elongated transition member and each pair of hammock support attachment means proximate the distal edge of the non-elastic elongated transition member. Each pair of hanging means includes an elongated rigid member fixed to the support structure by at least one non-elastic tensile member, typically a plurality of ropes. Each pair of hammock support attachment means is fixing to one pair of the hanging means. As such, in this embodiment, a pair of elongated transition members and a plurality of elastic cords can be added to typical existing hammocks in order to make the present invention. Each elastic cord and the flexible sheet suspend the load above the surface and conform to the shape and weight of the load.

In a third and fourth preferred embodiments, each cord engagement means is a looped elastic strap fixed at one end thereof to one of the opposing edges of the flexible sheet, and fixed at a looped second end thereof to one of the elongated support members with a flexible rope, or the like.

The present invention suspends a load above the surface and better conforms to the shape and size of the load. Such a hammock would utilize elastic cords to create a more comfortable and conforming hammock sheet to better cradle a person. Such a hammock is further adaptable to existing hammocks. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
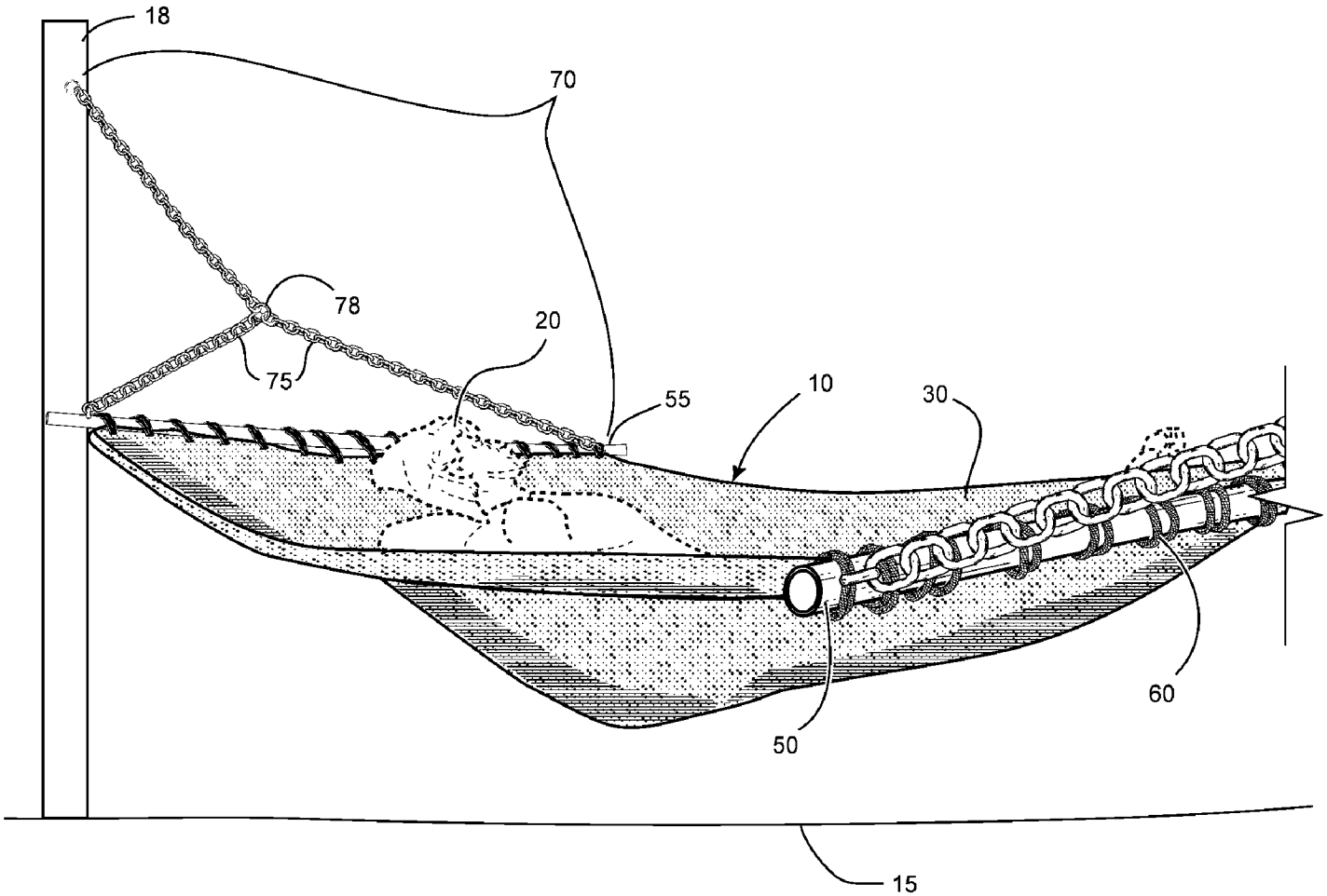
FIG. 1 is a perspective view of the invention.
Figure 2:
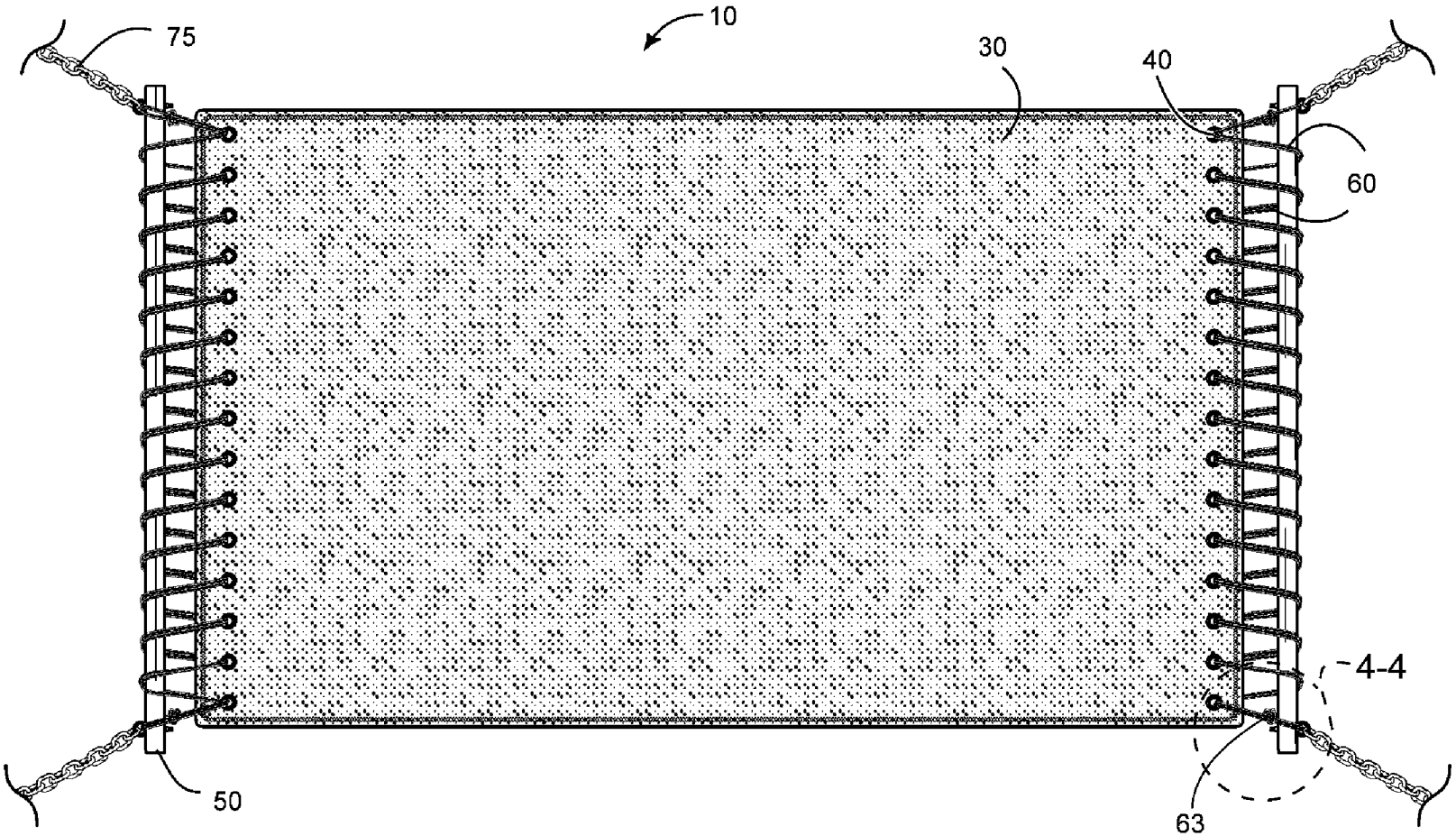
FIG. 2 is a top plan view of the invention.

FIGS. 1 and 2 illustrate a hammock 10 for supporting a load 20 above a surface 15 by a support structure 18. The hammock 10 includes a flexible sheet 30 that has at least two opposing edges 35. A plurality of cord engagement means 40 is further included proximate each opposing edge 35 of the flexible sheet 30. The cord engagement means 40 may be a grommet fixed through the flexible sheet 30.

Figure 4:
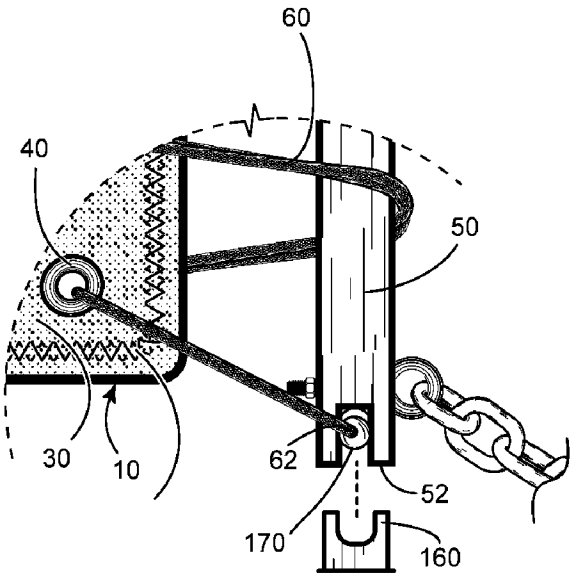
FIG. 4 is an enlarged partial top plan view of the invention illustrating the cord engagement means and a hanging means.
Figure 3:
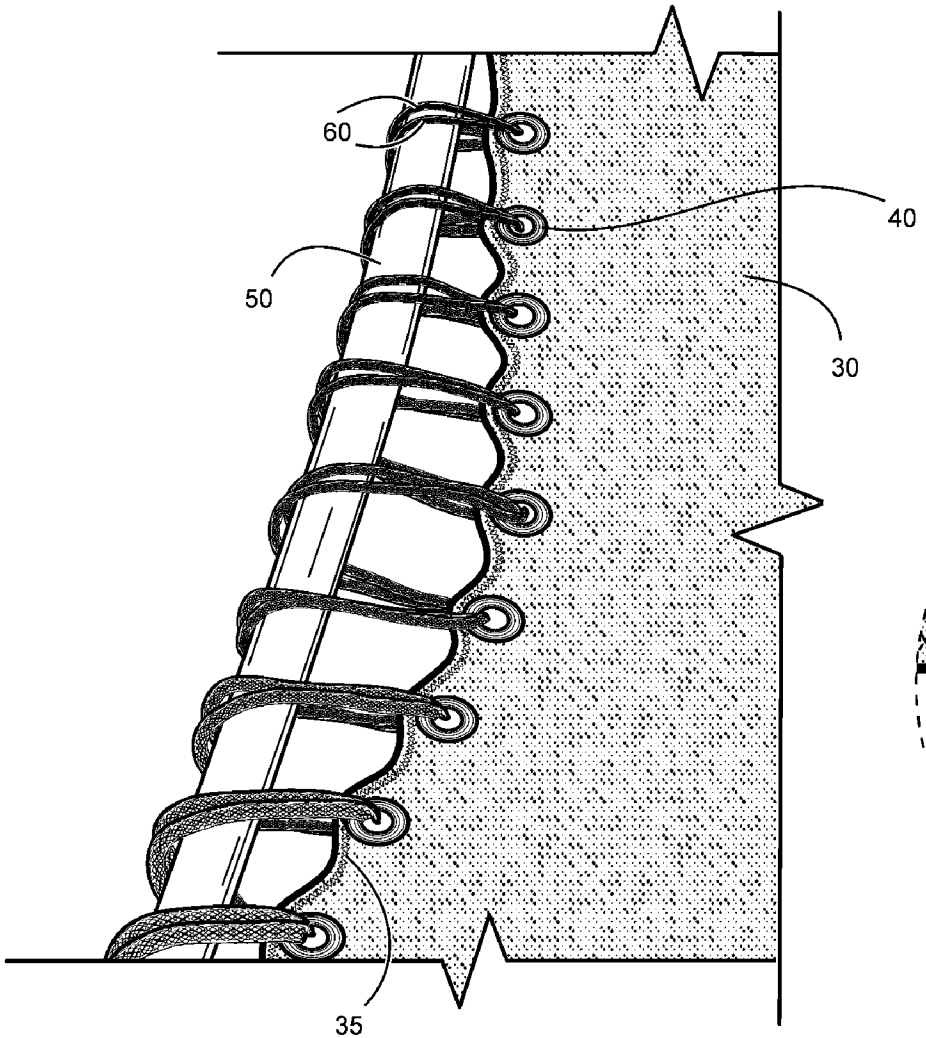
FIG. 3 is a partial perspective view of the invention, illustrating a cord engagement means.

In a first embodiment of the invention, the hammock 10 further includes a pair of elongated supporting members 50, each being a rigid metallic or wooden rod, for example. Each of the elongated supporting members 50 are attached to one edge 35 of the flexible sheet 30 at the cord engagement means 40 with at least one elastic cord 60 (FIGS. 3 and 4). The at least one elastic cord 60 may wrap around each elongated supporting member 50, or it may engage a plurality of rigid loops (not shown) fixed, such as by welding, to each supporting member 50. In such an embodiment, only about one-half of the elastic cord 60 is used. In an alternate embodiment of the invention, the elongated supporting member 50 is hollow and includes a slot (not shown) through which a plurality of rigid loops are slid to provide anchor points for the elastic cord 60 on the supporting member 50. Clearly a wide variety of means for attaching the elastic cord 60 can be utilized to fix the elastic cords 60 to the supporting member 50.

The elastic cord 60 may terminate at a slotted end 52 of the elongated support member, and secured thereto with a slotted cap 160 (FIG. 4). In such an embodiment, the elastic cord 60 is threaded through an anchor ball 170, or the like, to prevent an end 62 of the elastic cord 60 from unraveling from the elongated support member 50. Alternately, as illustrated in FIG. 2, the end 62 of the elastic cord 60 may be tied at the end 52 of the elongated supporting member 50 with a knot 63, or the like.

At least one hanging means 70 is included in the hammock 10. The hanging means 70 fixes each elongated supporting members 50 to the support structure 18. The hanging means 70 may be a pair of metallic chains 70, for example. Each pair of the metallic chains 70 is fixed at a proximal end to opposing ends 55 of one of the supporting rigid rods 50. Each metallic chain 70 may be mutually fixed at a distal end 75 thereof with a chain ring 78 that is further attached to the support structure 18.

In an alternate embodiment of the invention, the hanging means 70 is a pair of non-elastic ropes 72. Each pair of non-elastic ropes 72 is fixed at a proximal end to opposing ends 55 of one of the supporting rigid rods 50. The non-elastic ropes 72 are mutually fixed to the support structure 18, for example.

Figure 5:
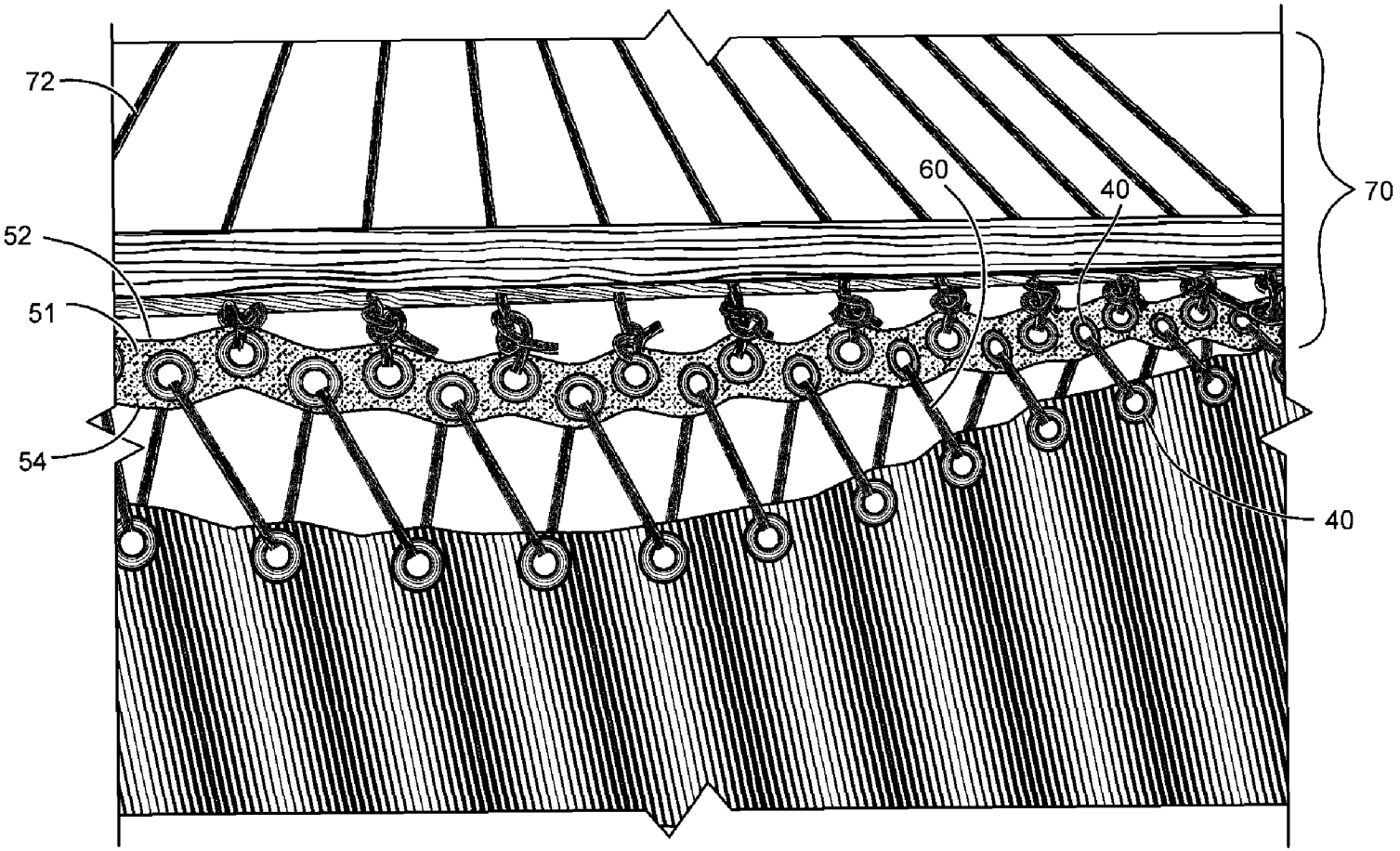
FIG. 5 is a partial perspective view of a second embodiment of the invention.

FIG. 5 illustrates a second preferred embodiment of the invention, wherein the elongated support means 50 is a non-elastic elongated transition member 51. The transition member 51 has a proximal edge 52 and a distal edge 54. The transition member 51 further includes a plurality of the cord engagement means 40 proximate the proximal edge 52 of the transition member 51. A plurality of the cord engagement means 40 are also included proximate the distal edge 54 of the transition member 51. In such an embodiment, each pair of hanging means 70 includes the elongated rigid member 50 fixed to the support structure 18 by at least one non-elastic tensile member 70, typically having been included in an existing hammock. Each of a pair of hammock support attachment means 80 (FIG. 1) is fixed to one pair of the hanging means 70. The non-elastic tensile members 70 may be a metallic chain or a flexible rope, for example. As such, adding the transition members 51 and the plurality of elastic cords 60 to an existing hammock in this fashion converts an existing hammock into the improved hammock 10 of the present invention.

Figure 6:
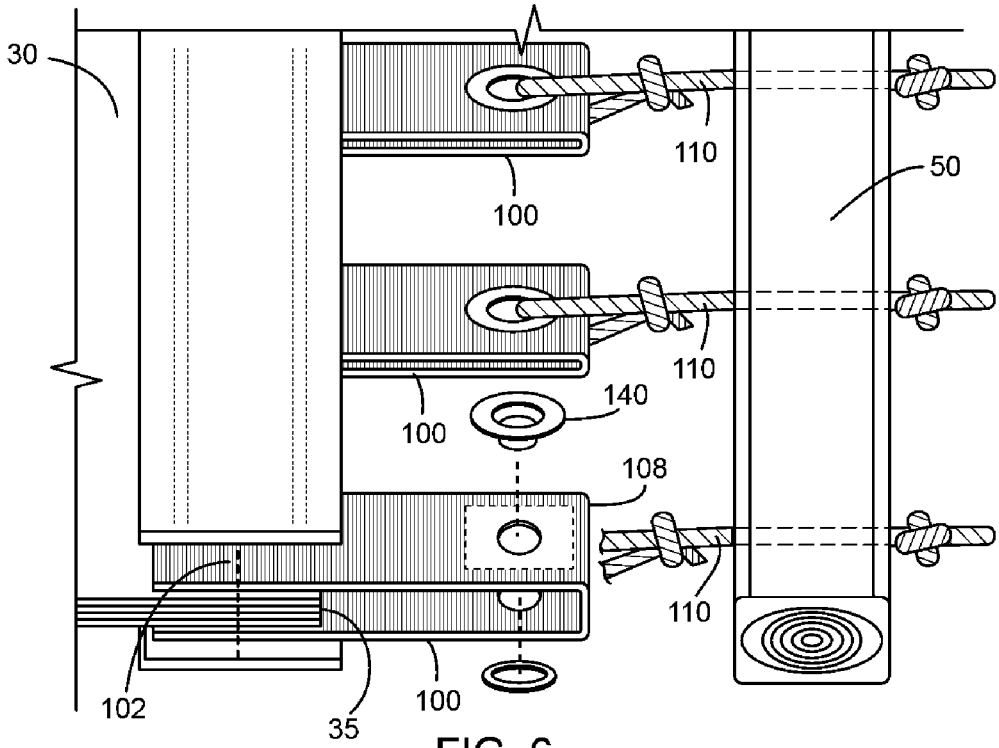
FIG. 6 is a partial, partially exploded perspective view of a third embodiment of the invention.
Figure 7:
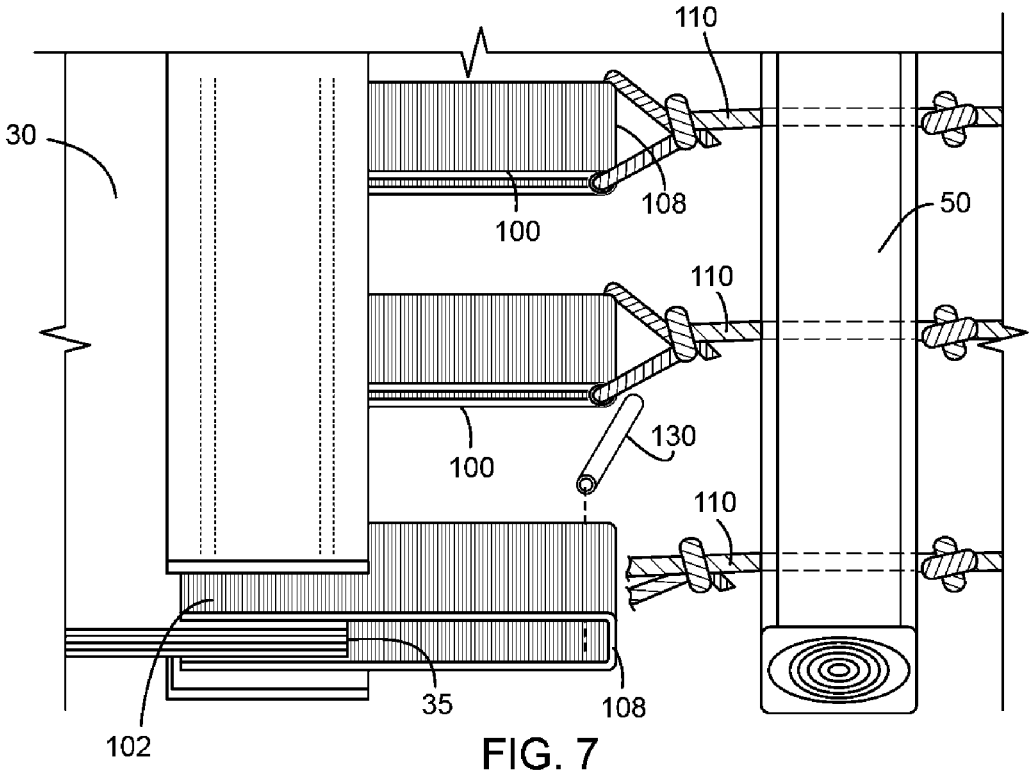
FIG. 7 is a partial, partially exploded perspective view of a forth embodiment of the invention.
Figure 8:
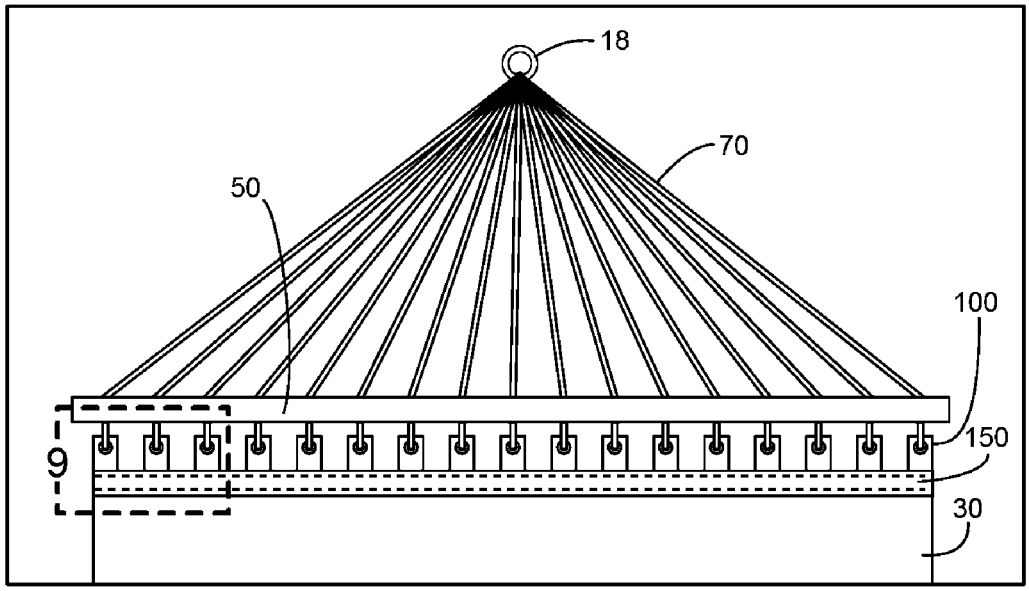
FIG. 8 is a partial top plan view of the third embodiment of the invention.
Figure 9:
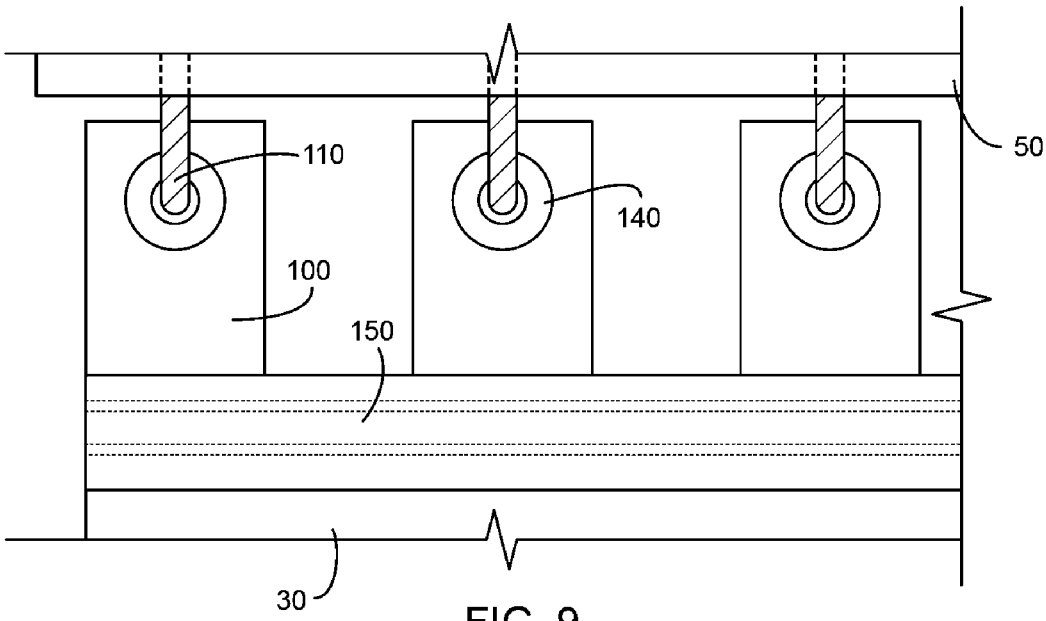
FIG. 9 is an enlarged top plan view of the invention, taken generally along lines 9-9 of FIG. 8.

A third and fourth preferred embodiment are illustrated in FIGS. 6-9, wherein each cord engagement means 40 is a looped elastic strap 100 fixed at one end 102 thereof to one of the opposing edges 35 of the flexible sheet 30, and fixed at a looped second end 108 thereof to one of the elongated support members 50 with a flexible non-elastic rope 110, the elastic cord 60 (not shown), or the like. The one end 102 of the elastic strap 100 may be sandwiched between two flexible fastener straps 150, for example, and sewn, ultrasonically welded, or the like (FIGS. 6 and 7). Each looped elastic strap 102 may be fixed to the flexible rope 110 with a grommet 140 traversing the strap 100 (FIGS. 6 and 9). Alternately, each looped elastic strap 100 may be fixed to the flexible rope 110 around the looped second end 108 thereof. In such an embodiment, for added strength, each elastic strap 100 may be looped around a semi-rigid strengthening tube 130 (FIG. 7), the flexible rope 110 traversing the strengthening tube 130.

In use, the elastic cord 60 and the flexible sheet 30 suspend the load 20 above the surface 15 and conform to the shape and weight of the load 20.

While a particular form of the invention has been illustrated and described, it will be apparent that various modifications can be made without departing from the spirit and scope of the invention. For example, other tensile members than ropes or chains may be used, such as rubber cords, plastic members, cables, or other suitable structures. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention. The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A hammock for supporting a load above a surface by a support structure, comprising:

a flexible sheet having at least two opposing edges, a plurality of cord engagement means included proximate each opposing edge of the flexible sheet;

a pair of elongated supporting members each attached to one edge of the flexible sheet at the cord engagement means with at least one elastic cord, each elongated supporting member being a rigid rod; and at least one hanging means fixing each supporting rod to the support structure, each hanging means being a pair of metallic chains each fixed at a proximal end to opposing ends of one of the rigid rods, and each mutually fixed at a distal end thereof with a chain ring, the chain ring attached with the support structure;

whereby the elastic cords and flexible sheet suspend the load above the surface and conform to the shape and weight of the load.

2. A hammock for supporting a load above a surface by a support structure, comprising:

a flexible sheet having at least two opposing edges, a plurality of cord engagement means included proximate each opposing edge of the flexible sheet;

a pair of elongated supporting members each attached to one edge of the flexible sheet at the cord engagement means with at least one elastic cord; and at least one hanging means fixing each supporting rod to the support structure, each elongated supporting member being a rigid rod, each hanging means being a pair of non-elastic ropes each fixed at a proximal end to opposing ends of one of the rigid rods, and each mutually fixed with the support structure;

whereby the elastic cords and flexible sheet suspend the load above the surface and conform to the shape and weight of the load.

3. A hammock for supporting a load above a surface by a support structure, comprising:

a flexible sheet having at least two opposing edges, a plurality of cord engagement means included proximate each opposing edge of the flexible sheet;

a pair of elongated supporting members each attached to one edge of the flexible sheet at the cord engagement means with at least one elastic cord; and at least one hanging means fixing each supporting rod to the support structure;

each elongated support means being a non-elastic elongated transition member having a proximal edge and a distal edge, and each having a plurality of the cord engagement means proximate the proximal edge thereof and a hammock support attachment means proximate the distal edge thereof, each hammock support attachment means adapted for fixing to one of the hanging means, each hanging means including an elongated rigid member fixed with the support structure by at least one non-elastic tensile member;

whereby the elastic cords and flexible sheet suspend the load above the surface and conform to the shape and weight of the load.

4. The hammock of claim 3 wherein at least one of the tensile members is a metallic chain.

5. The hammock of claim 3 wherein at least one of the tensile member is a flexible rope.

6. A hammock for supporting a load above a surface by a support structure, comprising:

a flexible sheet having at least two opposing edges, a plurality of cord engagement means included proximate each opposing edge of the flexible sheet;

a pair of elongated supporting members each attached to one edge of the flexible sheet at the cord engagement means with at least one elastic cord; and at least one hanging means fixing each supporting rod to the support structure;

each cord engagement means being a looped elastic strap fixed at one end thereof to one of the opposing edges of the flexible sheet, and fixed at a second end thereof to one of the elongated support members with a flexible rope;

whereby the elastic cords and flexible sheet suspend the load above the surface and conform to the shape and weight of the load.

7. The hammock of claim 6 wherein each looped elastic strap is fixed to the flexible rope with a grommet.

8. The hammock of claim 6 wherein each looped elastic strap is fixed to the flexible rope around the looped second end.

9. The hammock of claim 8 wherein each elastic strap is looped around a semi-rigid strengthening tube, the flexible rope traversing the strengthening tube.

* * * * *